US006231702B1

(12) United States Patent
Blomquist

(10) Patent No.: US 6,231,702 B1
(45) **Date of Patent: *May 15, 2001**

(54) COOL BURNING AMMONIUM NITRATE BASED GAS GENERATING COMPOSITION

(75) Inventor: Harold R. Blomquist, Gilbert, AZ (US)

(73) Assignee: TRW Inc., Lyndhurst, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/092,718

(22) Filed: Jun. 5, 1998

Related U.S. Application Data

(63) Continuation-in-part of application No. 09/026,980, filed on Feb. 20, 1998, now Pat. No. 6,143,104.

(51) Int. Cl.[7] ..... C06B 31/30; C06B 31/32

(52) U.S. Cl. ..... 149/36; 149/46; 149/47; 149/60; 149/61

(58) Field of Search ..... 149/46, 47, 36, 149/45, 19.4, 19.5, 19.9, 60–61

(56) References Cited

U.S. PATENT DOCUMENTS 3,715,131 * 2/1973 Hurley et al. ..... 280/736
3,912,562 * 10/1975 Garner ..... 149/41
3,954,528 * 5/1976 Chang et al. ..... 149/19.4
3,993,514 * 11/1976 Pacanowsky et al. ..... 149/19.5
4,111,728 * 9/1978 Ramnarace ..... 149/19.5
4,376,001 * 3/1983 Krone et al. ..... 149/19.9
4,948,439 * 8/1990 Poole et al. .
4,971,640 * 11/1990 Chi ..... 149/19.9
5,035,757 7/1991 Poole .
5,098,683 * 3/1992 Mehrotra et al. ..... 423/266
5,139,588 8/1992 Poole .
5,386,775 2/1995 Poole et al. .
5,529,647 * 6/1996 Taylor et al. ..... 149/2
5,531,941 * 7/1996 Poole ..... 264/3.4
5,545,272 8/1996 Poole et al. .
5,557,062 * 9/1996 MacLaren et al. ..... 149/46
5,589,661 * 12/1996 Menke et al. ..... 149/19.4
5,596,168 * 1/1997 Menke et al. ..... 149/19.4
5,847,315 * 12/1998 Katazakian et al. ..... 149/46
5,866,842 * 2/1999 Wilson et al. ..... 149/46
5,872,329 * 2/1999 Burns et al. ..... 149/36
6,143,104 * 11/2000 Blomquist ..... 149/61

* cited by examiner

*Primary Examiner*—Edward A. Miller
(74) *Attorney, Agent, or Firm*—Tarolli, Sundheim, Covell, Tummino & Szabo L.L.P.

(57) ABSTRACT

A gas generating composition comprises an organic fuel and an ammonium nitrate oxidizer which is phase stabilized with an alkali metal or alkaline earth metal salt. The composition also comprises an ammonium salt coolant selected from the group consisting of an ammonium halide, ammonium sulfate, and ammonium sulfamate. A preferred coolant is ammonium chloride.

11 Claims, No Drawings

COOL BURNING AMMONIUM NITRATE BASED GAS GENERATING COMPOSITION

This application is a continuation-in-part of application Ser. No. 09/026,980, filed Feb. 20, 1998, assigned to assignee of the present invention, and now U.S. Pat. No. 6,143,104.

FIELD OF THE INVENTION

The present invention relates to a non-azide based gas generating composition. The gas generating composition of the present invention is particularly useful for inflating an inflatable vehicle occupant protection device.

BACKGROUND OF THE INVENTION

Azide-based gas generating compositions for generating gas to inflate an inflatable vehicle occupant protection device have the advantage that they produce non-toxic nitrogen gas during combustion and produce gas at relatively low gas temperatures.

Non-azide based gas generating compositions, in contrast, typically produce gas at temperatures well above the temperature of gas produced by azide-based gas generating compositions with some approaching 4000° K. While these non-azide based gas generating compositions potentially are thermodynamically efficient, they present heat management problems.

For instance, it may be necessary, because of the high temperatures, to manufacture certain components of the vehicle occupant protection device of more expensive materials that are resistant to the high temperature gas which is generated. In addition the non-azide based gas generating compositions tend to produce reaction products which may be in the vapor phase at high temperature and thus more difficult to filter.

Various attempts to cool the non-azide based gas generating compositions include adding chemical coolants to the compositions. Chemical coolants, however, tend to add to the volume of the gas generating material required without increasing the gas output. This reduces the gas output per volume of gas generating material in an amount dependent upon the amount of coolant added.

Mechanical approaches to cooling the products of combustion of gas generating compositions involve using filters which function as both a heat exchanger and a particulate trap. However, the gas volume output tends to drop dependent upon the heat loss to the filter, especially if the particulate trapping in the filter is highly efficient.

SUMMARY OF THE INVENTION

The present invention resides in a gas generating composition which comprises an organic fuel and an oxidizer wherein the oxidizer is phase stabilized ammonium nitrate. The phase stabilizer for the ammonium nitrate is an alkali metal or alkaline earth metal salt. The composition further comprises an ammonium salt coolant selected from the group consisting of an ammonium halide, ammonium sulfate, and ammonium sulfamate. A preferred ammonium halide is ammonium chloride ($NH_4Cl$). The amount of ammonium salt coolant present in the gas generating composition is an amount effective, on combustion, to produce a reaction product of the anion of the ammonium salt coolant and the cation of the alkali metal or alkaline earth metal phase stabilizer. The ammonium salt coolant reacts with the alkali metal or alkaline earth metal salt in an endothermic reaction which reduces the combustion temperature of the combustion gas product. The combustion gas product is substantially free of alkali metal or alkaline earth metal oxide.

The ammonium salt coolant is in effect a fuel component, producing on combustion only gas or vapor phase products, thus achieving an increased gas output per unit volume of gas generating material used.

Preferably, the gas generating composition of the present invention also comprises a sinter-forming material which is present in the composition in an amount effective to cause liquid particles of the reaction product to coalesce into an easily filterable slag. Preferred sinter-forming materials are silicon dioxide ($SiO_2$) and aluminum oxide ($Al_2O_3$)

In an embodiment of the present invention, the mol ratio of the alkali metal or alkaline earth metal salt to ammonium salt coolant is about 1:1 for substantially complete reaction of the anion of the ammonium salt coolant with the alkali metal or alkaline earth metal cation of the phase stabilizer.

Preferably, the gas generating composition is balanced for substantially complete reaction of carbon in the organic fuel with oxygen in the oxidizer to produce carbon dioxide.

The present invention also resides in an inflatable vehicle occupant protection device which comprises an inflator for generating gas to inflate the protection device using the foregoing gas generating composition.

DESCRIPTION OF PREFERRED EMBODIMENTS

For purposes of the present application, the term "organic fuel" includes salts of organic fuels.

The gas generating composition of the present invention comprises a non-azide organic fuel, which can be any non-azide organic fuel typically used in a gas generating composition. Examples of organic fuels useful in the present invention are: cyanamides such as dicyandiamide and salts thereof; tetrazoles such as 5-amino-tetrazole (5-AT), and derivatives and salts of tetrazoles; carbonamides such as azo-bis-dicarbonamide and salts thereof; triazoles such as 3-nitro-1,2,4-triazole-5-one (NTO) and salts thereof; guanidine and derivatives thereof such as nitroguanidine; salts of guanidine and guanidine derivatives such as triaminoguanidine nitrate (TAGN) or guanidine nitrate (GN); tetramethyl ammonium nitrate; urea and urea salts; triazines and tetrazines such as trinitro-1,3,5-triazine (RDX), and octahydro-1,3,5,7-tetrazine (HMX); and combinations of such fuels.

The amount of fuel in the gas generating composition is that amount necessary to achieve sustained combustion of the gas generating composition. The amount can vary depending upon the particular fuel involved and other reactants. A preferred amount of fuel is in the range of about 10% to about 55% based on the weight of the gas generating composition.

The gas generating composition of the present invention also comprises phase stabilized ammonium nitrate as an oxidizer for the fuel. The amount of phase stabilized ammonium nitrate is that amount necessary to achieve sustained combustion with the fuel. A preferred amount of phase stabilized ammonium nitrate is in the range of about 30% to about 85% based upon the weight of the gas generating composition.

By the use of ammonium nitrate as the oxidizer for the fuel, a relatively smoke free combustion gas product is obtained. The products of combustion of the fuel and ammonium nitrate primarily are nitrogen, water, and carbon dioxide.

The phase stabilizer for the ammonium nitrate is an alkali metal or an alkaline earth metal salt. The stabilization of ammonium nitrate is necessary to avoid volumetric and structural changes associated with Phase IV ←→Phase III structural transitions due to the exposure of the gas generating composition to ambient temperature changes. Examples of alkali metal or alkaline earth metal salts which may be used include nitrates, nitrites, peroxides, and dinitramides. The amount of the phase stabilizer is an effective amount to stabilize ammonium nitrate and is up to about 15% based upon the weight of ammonium nitrate. This stabilization of ammonium nitrate is well known.

A critical component of the present invention is an ammonium salt coolant selected from the group consisting of an ammonium halide, an ammonium sulfate and an ammonium sulfamate. A preferred ammonium salt coolant is ammonium chloride ($NH_4Cl$).

The amount of ammonium salt coolant in the gas generating composition is preferably that amount which provides approximately a 1:1 mol ratio with the alkali metal or the alkaline earth metal salt stabilizer. This results in substantially complete reaction of the anion of the ammonium salt coolant with the alkali metal or alkaline earth metal cation of the phase stabilizer to produce a combustion gas product which is substantially free of alkali metal or alkaline earth metal oxide. A preferred amount of ammonium salt coolant is in the range of 1% to about 10% based on the weight of the gas generating composition.

In the present invention, the ammonium salt coolant reacts with the alkali metal or alkaline earth metal salt in an endothermic reaction which reduces the temperature of the combustion gas product. It was found that when the ammonium salt coolant is present in the gas generating composition in a mol ratio with the phase stabilizer which is approximately 1:1, the temperature of the combustion gas product was reduced a significant amount.

The present invention, also preferably comprises a sinter-forming material which forms a solid particulate sinter at the temperature of the combustion gas product. Preferred sinter-forming materials are aluminum oxide ($Al_2O_3$) and silicon dioxide ($SiO_2$). The amount of sinter-forming material is that amount effective to coalesce liquid particles of the reaction product into an easily filterable slag. The amount of sinter-forming material can be in the range of about 0% to about 10%, preferably in the range of about 4% to about 8%, based on the weight of the gas generating composition.

Preferably the components of the gas generating composition are present in a mol ratio adjusted to provide a combustion gas product which is substantially free of carbon monoxide; that is, wherein the carbon in the reaction mixture is substantially or completely oxidized to carbon dioxide.

The present invention can comprise other ingredients commonly added for a properly functioning system, such as burn rate modifiers, process aids, binders, and ignition aids.

EXAMPLES 1–12

The following examples illustrate the present invention.

In Examples 1–4 dicyandiamide is the fuel component. Example 1 is a control example, and Examples 2–4 are examples illustrating the present invention. The formulations and combustion results for Examples 1–4 are given in Table 1.

In Examples 5–8 the fuel is 5-amino-tetrazole (5-AT). Example 5 is a control example, and Examples 6–8 are examples illustrating the present invention. The formulations and combustion results for Examples 5–8 are given in Table 2.

In Examples 9–12, the fuel is nitroguanidine (NQ). Example 9 is a control example, and Examples 10–12 are examples illustrating the present invention. The formulations and results for Examples 9–12 are given in Table 3.

All of the combustion results for Tables 1, 2, and 3 are calculated. The formulations of Examples 2–4 in Table 1, Examples 6–8 in Table 2, and Examples 10–12 in Table 3 are based on a 1:1 mol ratio of ammonium salt coolant to the metal salt phase stabilizer, and an oxygen balance which produces carbon dioxide as a product, rather than carbon monoxide.

The term "Sp Impulse" in the Tables is a parameter indicating the amount of energy released during combustion of the gas generating composition based on a unit mass of gas generating material. The units are pounds force seconds/pounds mass.

TABLE 1

FORMULATIONS BASED ON DICYANDIAMIDE FUEL

| | EX 1 | EX 2 | EX 3 | EX 4 |
|---|---|---|---|---|
| Formulations | | | | |
| Dicyandiamide | 14.9 | 14.4 | 14.0 | 13.6 |
| Ammonium Nitrate | 85.1 | 79.2 | 73.5 | 68.1 |
| Potassium Nitrate | 0.0 | 4.2 | 8.2 | 12.0 |
| Ammonium Chloride | 0.0 | 2.2 | 4.3 | 6.3 |
| Performance Criteria | | | | |
| T Chamber, K | 2288 | 2277 | 2169 | 2113 |
| Exhaust moles gas/100 g | 4.26 | 4.13 | 4.01 | 3.90 |
| Gas mole weight | 23.4 | 24.0 | 24.5 | 25.0 |
| Sp impulse | 233.5 | 227.6 | 221.9 | 216.3 |
| Exhaust Composition, major components, calculated moles per 100 grams | | | | |
| Water | 2.48 | 2.40 | 2.33 | 2.26 |
| Nitrogen | 1.42 | 1.38 | 1.34 | 1.30 |
| Carbon dioxide | 0.356 | 0.345 | 0.335 | 0.325 |
| Potassium chloride | 0.0 | 0.0411 | 0.081 | 0.119 |

TABLE 2

FORMULATIONS BASED ON 5-AMINO-TETRAZOLE FUEL

| | EX 5 | EX 6 | EX 7 | EX 8 |
|---|---|---|---|---|
| Formulations | | | | |
| 5-amino-tetrazole | 23.3 | 22.6 | 22.0 | 21.4 |
| Ammonium Nitrate | 76.7 | 71.6 | 66.7 | 61.9 |
| Potassium Nitrate | 0.0 | 3.8 | 7.4 | 10.9 |
| Ammonium Chloride | 0.0 | 2.0 | 3.9 | 5.8 |
| Performance Criteria | | | | |
| T Chamber, K | 2414 | 2358 | 2304 | 2248 |
| Exhaust moles gas/100 g | 4.26 | 4.14 | 4.02 | 3.90 |
| Gas mole weight | 23.5 | 24.9 | 24.4 | 24.9 |
| Sp impulse | 239 | 234 | 228.7 | unknown |
| Exhaust Composition, major components, calculated moles per 100 grams | | | | |
| Water | 2.32 | 2.26 | 2.20 | 2.14 |
| Nitrogen | 1.65 | 1.60 | 1.56 | 1.51 |
| Carbon dioxide | 0.28 | 0.27 | 0.26 | 0.25 |
| Potassium chloride | 0.0 | 0.037 | 0.073 | 0.11 |

TABLE 3

| FORMULATIONS BASED ON NITROGUANIDINE FUEL | | | | |
|---|---|---|---|---|
| | EX 9 | EX 10 | EX 11 | EX 12 |
| Formulations | | | | |
| Nitroguanidine | 39.4 | 38.5 | 37.7 | 36.8 |
| Ammonium Nitrate | 60.6 | 56.9 | 53.3 | 49.7 |
| Potassium Nitrate | 0.0 | 3.0 | 5.9 | 8.8 |
| Ammonium Chloride | 0.0 | 1.6 | 3.1 | 4.6 |
| Performance Criteria | | | | |
| T Chamber, K | 2461 | 2414 | 2371 | 2329 |
| Exhaust moles gas/100 g | 4.18 | 4.07 | 3.98 | 3.90 |
| Gas mole weight | 23.9 | 24.4 | 24.7 | 25.1 |
| Sp impulse | 240 | 235.8 | 232 | 228 |
| Exhaust Composition, major components, calculated moles per 100 grams | | | | |
| Water | 2.3 | 2.2 | 2.2 | 2.1 |
| Nitrogen | 1.5 | 1.5 | 1.4 | 1.4 |
| Carbon dioxide | 0.38 | 0.37 | 0.36 | 0.35 |
| Potassium chloride | 0.0 | 0.028 | 0.057 | 0.085 |

Referring to Table 1, control Example 1 is a formulation containing no coolant such as ammonium chloride. The ammonium nitrate in the formulation is not phase stabilized. Combustion of the composition of Example 1 yields a chamber temperature of about 2288K.

Example 2 is a formulation which contains 2.2% ammonium chloride coolant. The ammonium nitrate in the formulation is phase stabilized with 5 weight % of potassium nitrate based on the total weight of phase stabilized ammonium nitrate, i.e. the weight of the ammonium nitrate plus the weight of the potassium nitrate. The ammonium chloride is in a 1:1 mol ratio with the potassium nitrate and produces 0.0411 moles of potassium chloride as a reaction product. The reaction of the ammonium chloride with the potassium nitrate is an endothermic reaction which reduces the combustion chamber temperature to 2277K. The mol ratio of fuel (dicyandiamide) to oxygen in the oxidizer is adjusted for substantially complete oxidation of carbon atoms in the fuel to carbon dioxide.

Example 3 is a formulation which contains 4.3% ammonium chloride coolant. The ammonium nitrate in the formulation is phase stabilized with 10 weight percent of potassium nitrate based on the total weight of phase stabilized ammonium nitrate, i.e. the weight of the ammonium nitrate plus the weight of the potassium nitrate. The ammonium chloride is in a 1:1 mol ratio with the potassium nitrate and produces 0.081 moles of potassium chloride as a reaction product. The reaction of the ammonium chloride with the potassium nitrate is an endothermic reaction which reduces the combustion chamber temperature to 2169K. The mol ratio of fuel (dicyandiamide) to oxygen in the oxidizer also is adjusted for substantially complete oxidation of carbon atoms in the fuel to carbon dioxide.

Example 4 is a formulation which contains about 6.3% ammonium chloride coolant. The ammonium nitrate in the formulation is phase stabilized with 15 weight percent of potassium nitrate based on the total weight of phase stabilized ammonium nitrate, i.e. the weight of the ammonium nitrate plus the weight of the potassium nitrate. The ammonium chloride is in a 1:1 mol ratio with the potassium nitrate and produces 0.119 moles of potassium chloride as a reaction product. As in Examples 2 and 3, the reaction of the ammonium chloride with the potassium nitrate is an endothermic reaction which reduces the combustion chamber temperature to 2113K. The mol ratio of fuel (dicyandiamide) to oxygen in the oxidizer also is adjusted for substantially complete oxidation of carbon atoms in the fuel to carbon dioxide.

In Examples 2, 3, and 4, the combustion gas product has a low toxicity in addition to a significant reduction in temperature as compared to Example 1. The major gaseous components of the gas product, in addition to carbon dioxide (the potassium chloride being filterable), are water and nitrogen.

In Examples 2, 3, and 4, the amount of gas produced in the combustion reaction, and its energy, are effective for activating a vehicle occupant protection device such as an air bag.

In this respect, it can be noted that the present invention although primarily useful for inflating a vehicle occupant protection device, can have other uses, for instance for inflating other types of inflatable vehicle safety devices, inflatable rafts and other such devices.

Results, similar to those of Table 1 are disclosed in Table 2 (Examples 5–8) and in Table 3 (Examples 9–12) where 5-amino-tetrazole and nitroguanidine are used, respectively, as the fuel.

Advantages of the present invention should be apparent. Primarily, the present invention takes advantage of the phase stabilization of ammonium nitrate with an alkali metal or alkaline earth metal salt. A mixture of phase stabilized ammonium nitrate and a non-azide organic fuel is a desirable gas generating material since the combustion of the ammonium nitrate and the organic fuel yields a gas product which is primarily nitrogen, carbon dioxide and water. In the present invention, the applicant discovered that by adding an amount of a salt such as ammonium chloride, an endothermic reaction occurs which reduces the combustion temperature of the reaction mixture. When the amount of coolant used is balanced for substantially complete reaction of the anion of the coolant, for instance chloride, with the metal cation of the phase stabilizer, there is not only a significant reduction in the temperature of the combustion gas product, but also the production of a relatively low-toxicity gas, particularly one which is free of alkali metal or alkaline earth metal oxides.

Also, since the ammonium salt coolant is in effect a fuel component, producing on combustion gas or vapor phase products, an increased output per unit volume of gas generating material is achieved.

From the above description of the invention, those skilled in the art will perceive improvements, changes and modifications. Such improvements, changes and modifications within the skill of the art are intended to be covered by the appended claims.

What is claimed is:

1. A gas generating composition suitable for inflating a vehicle occupant protection device comprising:

an organic fuel;

phase stabilized ammonium nitrate wherein the phase stabilizer is an alkali metal nitrate, an alkali metal nitrite, an alkali metal peroxide, an alkali metal dinitramide, an alkaline earth metal nitrate, an alkaline earth metal nitrite, an alkaline earth metal peroxide, an alkaline earth metal dinitramide, or a combination thereof; and an ammonium halide coolant, wherein the gas generating composition produces, upon combustion, a reaction product which comprises the anion of the ammonium halide coolant reacted with the alkali metal or alkaline earth metal cation of the phase stabilizer.

2. The composition of claim 1 wherein the amount of ammonium halide coolant and the amount of phase stabilizer are balanced for substantially complete reaction of the anion of the ammonium halide coolant with the alkali metal or alkaline earth metal cation of the phase stabilizer, the combustion gas product from combustion of the gas generating composition being substantially free of alkali metal or alkaline earth metal oxide.

3. The composition of claim 1 wherein the ammonium halide coolant is ammonium chloride.

4. The composition of claim 1 further comprising a sinter-forming material.

5. The composition of claim 4 wherein the sinter-forming material is selected from the group consisting of aluminum oxide and silicon dioxide.

6. The composition of claim 1 wherein the organic fuel is selected from the group consisting of cyanamides, tetrazoles, carbonamides, triazoles, guanidines, salts of guanidine, tetramethyl ammonium nitrate, triazines, tetrazines, urea, salts of urea, and combinations thereof.

7. The gas generating composition of claim 2 comprising about 10 to about 55 weight % organic fuel and about 30 to about 85 weight % phase stabilized ammonium nitrate.

8. The composition of claim 7 further comprising 0 to about 10 weight % of sinter-forming material.

9. The gas generating composition of claim 1 wherein the gas generating composition is balanced for substantially complete reaction of the carbon in the organic fuel with the oxygen in the phase stabilized ammonium nitrate to produce carbon dioxide.

10. A gas generating composition comprising:

about 10 to about 55 weight % of an organic fuel selected from the group consisting of cyanamides, tetrazoles, carbonamides, triazoles, guanidines, salts of guanidine, tetramethyl ammonium nitrate, triazines, tetrazines, urea, salts of urea, and combinations thereof;

about 30 to about 85 weight % of phase stabilized ammonium nitrate, wherein the phase stabilizer comprises about 5 to about 15 weight %, based on the total weight of the phase stabilized ammonium nitrate, and is selected from the group consisting of alkali metal nitrates, alkali metal nitrites, alkali metal peroxides, alkali metal dinitramides, alkaline earth metal nitrates, alkaline earth metal nitrites, alkaline earth metal peroxides, alkaline earth metal dinitramides, and combinations thereof;

an ammonium chloride coolant;

0 to about 10 weight % of a sinter forming material selected from the group consisting of aluminum oxide and silicon dioxide;

wherein the ammonium chloride coolant and the phase stabilizer are present in about a molar ratio for substantially complete reaction of the alkali metal or alkaline earth metal cation of the phase stabilizer with the chloride ion of the coolant to produce, upon combustion, a reaction product substantially free of alkali metal or alkaline earth metal oxide.

11. The gas generating composition of claim 10 wherein the gas generating composition is balanced for substantially complete reaction of the carbon in the organic fuel with the oxygen in the oxidizer to produce carbon dioxide.

* * * * *